United States Patent [19]

Niklaus

[11] Patent Number: 4,986,426

[45] Date of Patent: Jan. 22, 1991

[54] PRESENTATION STAND INTENDED FOR WATCHES

[75] Inventor: Bruno Niklaus, Biel, Switzerland

[73] Assignee: Swatch A.G., Switzerland

[21] Appl. No.: 429,573

[22] Filed: Oct. 31, 1989

[30] Foreign Application Priority Data

Nov. 2, 1988 [CH] Switzerland ..... 04075/88

[51] Int. Cl.[5] ..... A47F 7/00

[52] U.S. Cl. ..... 211/13; 248/116

[58] Field of Search ..... 211/13; 248/114, 115, 248/116, 444.1, 459

[56] References Cited

U.S. PATENT DOCUMENTS

| | | | |
|---|---|---|---|
| 1,136,520 | 4/1915 | Fukami | 248/115 X |
| 3,809,352 | 5/1974 | Mathias | 248/444.1 |
| 4,607,817 | 8/1986 | Aquino | 248/460 |
| 4,646,920 | 3/1987 | Kruger | 211/13 |
| 4,877,212 | 10/1989 | Kobayashi | 248/444.1 |

FOREIGN PATENT DOCUMENTS

| | | | |
|---|---|---|---|
| 311997 | 5/1919 | Fed. Rep. of Germany | 248/116 |
| 881254 | 6/1953 | Fed. Rep. of Germany | 248/116 |
| 2551466 | 5/1977 | Fed. Rep. of Germany | 248/441.1 |
| 79733 | 3/1919 | Switzerland | 248/115 |
| 247575 | 3/1947 | Switzerland | 248/116 |

*Primary Examiner*—David L. Talbott

*Attorney, Agent, or Firm*—Pollock, Vande Sande & Priddy

[57] ABSTRACT

This presentation stand comprises a presentation plate provided with hooks for receiving objects and support means whereby the stand may be set down on a horizontal plane. It likewise comprises a retention plate extending in front of the presentation plate and parallel thereto as well as attaching means for fastening the stand to a vertical plane and coupling means for attaching the support means to the presentation plate.

20 Claims, 2 Drawing Sheets

2
4
6
8
10
12
14
16
18
20
22
24
26

PRESENTATION STAND INTENDED FOR WATCHES

TECHNICAL FIELD

This invention concerns a presentation stand intended to receive a variety of objects such as watches, butterflies or others. In particular the invention concerns a presentation stand which may be set down on a horizontal plane or fastened to a vertical plane.

The presentation stand in accordance with this invention may find use in shops for displaying objects intended for sale as well as for stowing objects in an orderly manner in a domestic framework.

BACKGROUND OF THE INVENTION

Presentation stands or storage devices for familiar objects such as neckties, keys or clothing are well known. However, a presentation stand especially provided for the stowing or presentation of watches seems not to be known. Nevertheless, watches have become over the last several years consumer items of a nature such that many persons may possess several of them.

The tidy stowing of these watches gives rise to a special problem particularly when the watch bracelet tends to maintain the form of the wrist as is the case for bracelets of leather, plastic materials or textiles.

Furthermore, contrary to necktie or clothing supports which are designed to be hung in a clothes closet or fastened to a wall, it is desirable that, in a domestic setting a stand for objects such as watches may be either set down on a horizontal plane, for instance on a desk or shelf, or fastened to a wall, for instance in a kitchen, a bathroom or a bedroom. In the same manner, in the case where the presentation stand is employed in the show window of a shop for displaying objects intended for sale, it is of interest to be able either to set down the presentation stand or to fasten it, as much for practical reasons as for matters of appearance.

SUMMARY OF THE INVENTION

The problem as set forth is solved in accordance with the invention by a presentation stand comprising a presentation plate provided with receiving means adapted to receive the objects to be presented and support means having a first extremity coupled to the presentation plate and a second extremity diverging from said plate, whereby the presentation stand may be set down on a substantially horizontal surface, said presentation stand being characterized in that it additionally comprises attaching means for fastening said presentation stand to a substantially vertical plane, coupling means for separably attaching the second extremity of the support means to the presentation plate when the presentation stand is fastened to a substantially vertical plane and a retention plate extending in front of the presentation plate, said plates being substantially parallel and the distance between them being slightly greater than the thickness of the objects to be presented.

It is evident that the presentation stand as proposed may be employed for objects other than watches. In general, it enables presentation of objects which may have different forms according to whether or not they are placed in the presentation stand. The stand in accordance with the invention may thus likewise be employed for the stowing of butterflies.

The retention plate may overlay at least half of each object presented or may include a plurality of parallel strips. In the latter case, when the stand is intended for displaying watches, the retention plate may comprise at least two strips, each overlaying at least a portion of a watch bracelet strand.

The characteristics and advantages of the invention will be better understood from the description to follow given by way of non-limiting examples and in having reference to the attached drawings.

DESCRIPTION OF THE PREFERRED EMBODIMENT

Figures 1, 2, 3, 4, 5:
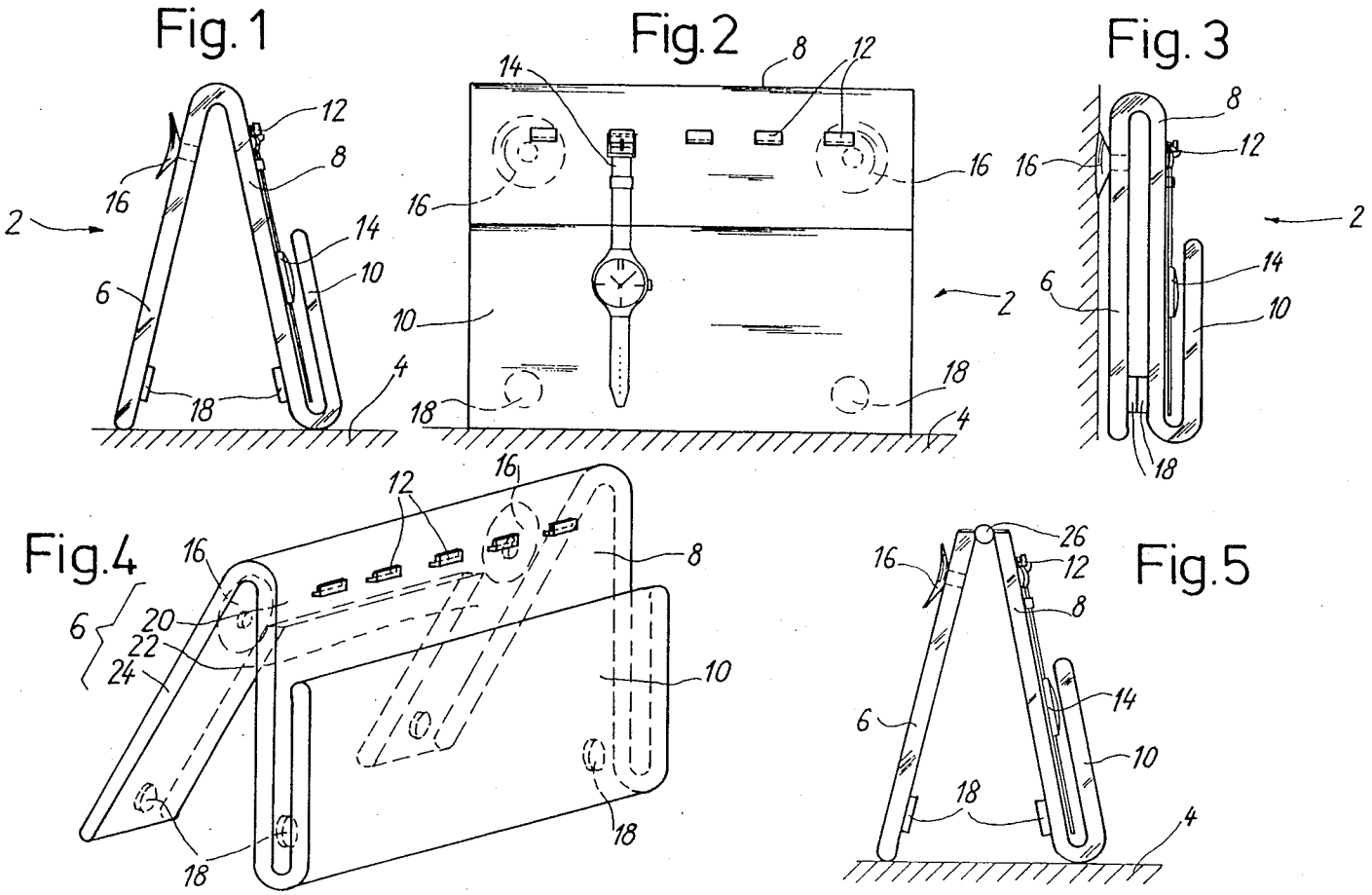
FIGS. 1 and 2 illustrate respectively a side view and a facing view of a presentation stand in accordance with a first embodiment of the invention.
FIG. 3 shows a side view of the same stand fastened to a substantially vertical plane.
FIG. 4 illustrates a variant of the embodiment in which the support means are formed by two feet.
FIG. 5 shows a variant in which the coupling between the presentation plate and the support means comprises a hinge.

FIGS. 1 and 2 illustrate a presentation stand 2 in accordance with the invention set down on a horizontal plane 4. This stand is essentially constituted from a single plate folded at two places which define a first portion which forms a support means 6, a second portion forming a presentation plate 8 and a third portion forming a retention plate 10. Receiving means 12 such as hooks are provided on the presentation plate 8 for receiving watches 14. Plate 6 includes one side coupled to the presentation plate and another side diverging from the plate whereby the presentation stand may be set down on plane 4.

The presentation stand according to the invention likewise includes means enabling the fastening thereof to a substantially vertical plane as shown on FIG. 3. These attaching means 16 may be formed for instance by suction cups, particularly where the presentation stand is intended to be fastened in a bathroom or kitchen. Such means could also be constituted by screws or any other known type of fastener. Coupling means 18, preferably of the magnetic type, are furthermore provided on the facing surfaces of the presentation plate 8 and plate 6. Such coupling means assure improved rigidity of the presentation stand when it is fastened to a vertical plane whilst rendering the display of watches more attractive.

The presentation stand in accordance with the invention is finally characterized in that it comprises a retention plate 10 which extends parallel to the presentation plate 8 and in front thereof in order to provide a gap having a thickness slightly greater than that of the objects to be displayed.

This retention plate 10 enables an efficient and attractive stowage of watches and in particular watches having leather, plastic or textile bracelets which after having been worn, tend to maintain the form of the wrist.

The presentation stand shown on FIGS. 1 to 3 is particularly interesting since it is of simple and inexpensive construction whilst having an attractive appearance. Effectively, the essential elements of this stand, to wit plates 6, 8 and 10, are obtained by bending or folding a single plate, for instance of plexiglas (registered trademark).

The presentation stand shown on FIGS. 1 to 3 constitutes a preferred embodiment of the invention. It is evident that other embodiments may be envisaged. By way of example, some useful embodiments are shown on FIGS. 4 to 9.

The stand shown on FIG. 4 is different from that shown on FIGS. 1 and 2, essentially in respect of the method of obtaining support means 6. The latter here comprises a strip 20 coupled to the upper portion of the presentation plate 8, this strip being extended by two feet 22, 24 which assure the stability of the stand when it is set down on a horizontal plane.

In the embodiment of FIG. 5, plate 6 and presentation plate 8 are coupled by a hinge 26. Such hinge will advantageously include a point of resistance in order to define the optimum angle between plates 6 and 8 when the stand is set down on a horizontal plane.

Figure 6B:
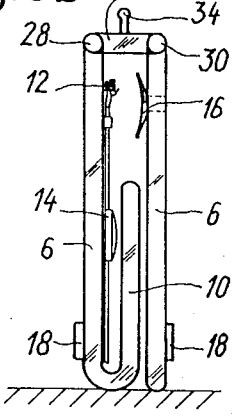
FIGS. 6*a* and 6*b* illustrate a presentation stand according to the invention which may be transformed into an attaché case for transport purposes.
Figure 6A:
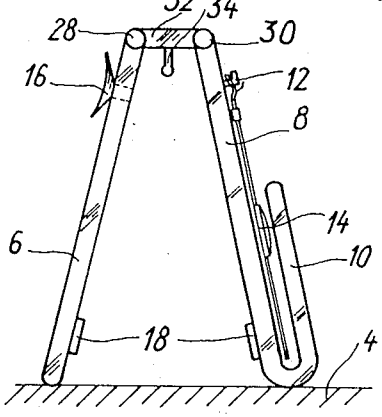

The coupling between plate 6 and plate 8 may likewise be obtained by an assembly comprising two hinges 28, 30 and a strip 32 as is shown on FIGS. 6*a* and 6*b*. This structure is slightly more complicated but provides the advantage that plate 6 may be folded back in front of the retention plate 10 (FIG. 6*b*). The presentation stand is thus transformed into an attaché case for transport purposes by simply adding a handle 34 to strip 32.

Figure 7:
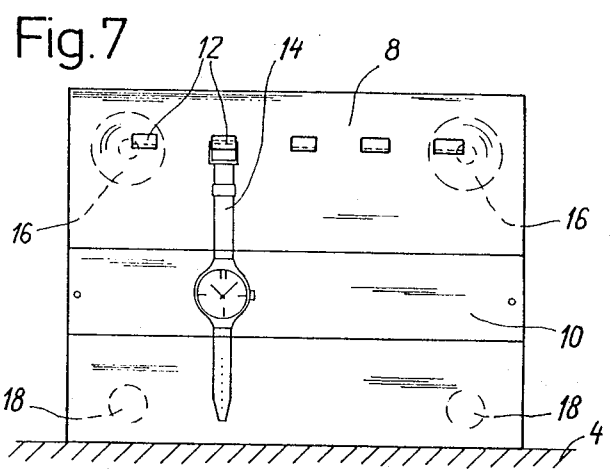
FIGS. 7, 8 and 9 illustrate variants of the retention plate.
Figure 9:
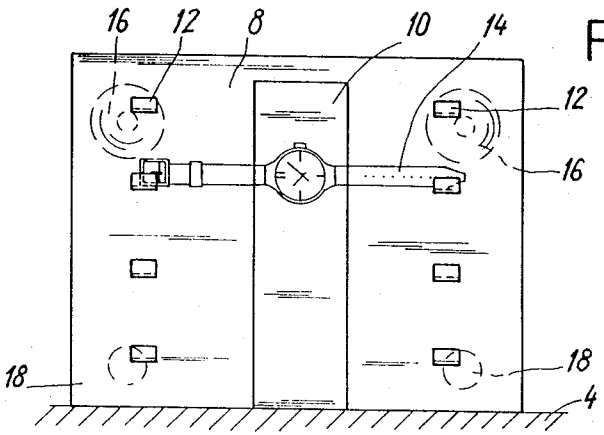
Figure 8:
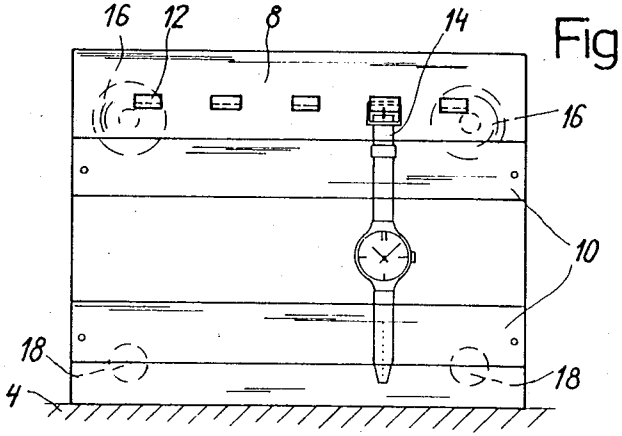

Different forms of the retention plate 10 are shown on FIGS. 7 to 9. The purpose of this plate is to prevent the object being displayed from separating from the presentation plate 8.

This retention plate 10 may be formed from a relatively narrow strip overlaying solely the watch case (FIG. 7) or of two strips 10*a*, 10*b* each arranged to overlay a portion of a bracelet strand close to the watch case (FIG. 8). Finally, the retention plate 10 may be arranged horizontally as well as vertically (FIG. 9).

What I claim is:

1. A presentation stand comprising:

a presentation plate having a front face and a rear face and provided with receiving means on said front face adapted to receive at least one object to be presented;

support means having a front face and a rear face and comprising a first extremity coupled to the presentation plate and a second extremity movable to a position in which said second extremity diverges from said plate to support the presentation stand when it is set down on a substantially horizontal surface, in which position the front face of said support means faces the rear face of said presentation plate;

attaching means provided on the rear face of said support means for fastening said presentation stand to a substantially vertical surface when the rear face of said support means is placed opposite said vertical surface;

coupling means provided on the rear face of said presentation plate and the front face of said support means for separably attaching the second extremity of the support means to the presentation plate when the presentation stand is fastened to said vertical surface; and, a retention plate extending in front of at least a portion of the front face of the presentation plate, said plates being substantially parallel and the distance between them being slightly greater than the thickness of the object to be presented.

2. A presentation stand as set forth in claim 1 wherein the retention plate overlays at least half of the object to be presented.

3. A presentation stand as set forth in claim 2 wherein the object to be presented is a watch and the retention plate overlays at least the watch case.

4. A presentation stand as set forth in claim 3 wherein the retention plate and the presentation plate are obtained by folding a single plate.

5. A presentation stand as set forth in claim 2 wherein the retention plate and the presentation plate are obtained by folding a single plate.

6. A presentation stand as set forth in claim 1 wherein the retention plate includes a plurality of parallel strips.

7. A presentation stand as set forth in claim 6 wherein the object to be presented is a watch and the retention plate comprises at least two strips arranged so that each overlays at least a portion of watch bracelet strand.

8. A presentation stand as set forth in claim 1 wherein the support means is formed by a plate having a first side coupled to the presentation plate and a second side forming the base of the support means.

9. A presentation stand as set forth in claim 8 wherein the support means and the presentation plate are formed by folding a single plate.

10. A presentation stand as set forth in claim 1 wherein the coupling means is of a magnetic type.

11. A presentation stand as set forth in claim 1 wherein said receiving means is adapted to receive a plurality of the objects to be presented.

12. A presentation stand comprising:

a presentation plate having a front face and a rear face and provided with receiving means on said front face adapted to receive at least one object to be presented;

support means having a front face and a rear face and comprising a first extremity coupled to the presentation plate and a second extremity movable to a first position in which said second extremity diverges from said plate to support the presentation stand when it is set down on a substantially horizontal surface, in which first position the front face of said support means faces the rear face of said presentation plate;

pivot means for coupling said first extremity to the presentation plate and for providing movement of said second extremity between said first position and a second position in which said second extremity is substantially parallel to said plate;

attaching means provided on the rear face of said support means for fastening said presentation stand to a substantially vertical surface when said second extremity is moved to its second position and the rear face of said support means is placed opposite said vertical surface; and, a retention plate extending in front of at least a portion of the front face of the presentation plate, said plates being substantially parallel and the distance between them being slightly greater than the thickness of the object to be presented.

13. A presentation stand as set forth in claim 12 wherein the support means is formed by a support plate having a first side portion coupled to the presentation plate and a second side portion providing a base part of the support means, wherein the support plate and the presentation plate are formed by folding a single plate of material, and wherein coupling means is provided on the rear face of the presentation plate and the front face of the support plate for separably attaching the base part of the support plate to the presentation plate when said second extremity is moved to its second position.

14. A presentation stand as set forth in claim 12 wherein said pivot means comprises hinge means coupling said first extremity to the presentation plate for rotation of the support means relative to the presentation plate about an axis of said hinge means.

15. A presentation stand as set forth in claim 14 further comprising positioning means for positioning said second extremity in spaced relation to an opposing portion of said presentation plate when said second extremity is in its second position.

16. A presentation stand as set forth in claim 15 wherein said support means comprises a plate, a first side portion of which forms said first extremity coupled to the presentation plate and a second side portion of which forms said second extremity and provides a base part of the support means.

17. A presentation stand as set forth in claim 14 wherein said hinge means comprises two hinge elements separated by a linking strip such that the support means may be rotated relative to the presentation plate to a third position in which the rear face of the support means is opposite the front face of the presentation plate and cooperates with the retention plate to protect the object to be presented.

18. A presentation stand as set forth in claim 17 further comprising handle means attached to said linking strip such that said handle means extends between the support means and the presentation plate when said second extremity is in its first position and extends away from the retention plate when said second extremity is in its third position.

19. A presentation stand comprising:

a presentation plate having a front face and a rear face and provided with receiving means on said front face for receiving at least one object to be presented and suspending said object adjacent to the front face of said plate;

support means having a front face and a rear face and comprising a first extremity coupled to the presentation plate and a second extremity movable to a position in which said second extremity diverges from said plate to support the presentation stand when it is set down on a substantially horizontal surface, in which position the front face of said support means faces the rear face of said presentation plate;

attaching means provided on the rear face of said support means for fastening said presentation stand to a substantially vertical surface when the rear face of said support means is placed opposite said vertical surface;

a retention plate extending in front of at least a portion of the front face of the presentation plate; and, means for connecting together base parts of said plates such that said plates are substantially parallel and the distance between them is slightly greater than the thickest part of the object to be presented, said receiving means being positioned relative to the retention plate such that the retention plate overlays said thickest part of the object to be presented and said object is suspended above said base parts of the plates.

20. A presentation stand as set forth in claim 19 wherein said receiving means is adapted to receive and to suspend at spaced intervals a plurality of objects to be presented.

* * * * *